US007081877B2

(12) United States Patent
Bu et al.

(10) Patent No.: US 7,081,877 B2
(45) Date of Patent: Jul. 25, 2006

(54) APPARATUS AND METHOD FOR DATA SIGNAL SCATTERING CONVERSION

(75) Inventors: Lin-Kai Bu, Tainan (TW); Chuan-Cheng Hsiao, Chiai (TW)

(73) Assignee: Hi Max Optoelectronics Corp. (TW)

( * ) Notice: Subject to any disclaimer, the term of this patent is extended or adjusted under 35 U.S.C. 154(b) by 133 days.

(21) Appl. No.: 10/121,660

(22) Filed: Apr. 15, 2002

(65) Prior Publication Data

US 2002/0149608 A1 Oct. 17, 2002

(30) Foreign Application Priority Data

Apr. 17, 2001 (TW) ..... 90109219 A

(51) Int. Cl.
*G09G 3/36* (2006.01)

(52) U.S. Cl. ..... 345/98; 345/100; 315/169.1

(58) Field of Classification Search ..... 345/100, 345/99, 98, 90, 92, 214, 690, 76, 204; 455/137, 455/310, 341; 315/169.1, 169.3; 327/107; 341/144, 142, 114

See application file for complete search history.

(56) References Cited

U.S. PATENT DOCUMENTS

| | | | | |
|---|---|---|---|---|
| 5,015,884 A * | 5/1991 | Agrawal et al. | ..... | 326/39 |
| 5,374,860 A * | 12/1994 | Llewellyn | ..... | 327/276 |
| 5,917,634 A * | 6/1999 | Otobe | ..... | 398/201 |
| 5,937,116 A * | 8/1999 | Seto | ..... | 385/24 |
| 6,100,868 A * | 8/2000 | Jeong et al. | ..... | 345/98 |
| 6,266,041 B1 * | 7/2001 | Cairns et al. | ..... | 345/100 |
| 6,400,394 B1 * | 6/2002 | Kim et al. | ..... | 348/51 |
| 6,553,021 B1 * | 4/2003 | Bishop et al. | ..... | 370/347 |
| 6,687,315 B1 * | 2/2004 | Keevill et al. | ..... | 375/341 |

FOREIGN PATENT DOCUMENTS

| | | |
|---|---|---|
| EP | 0837446 | 4/1998 |
| JP | 06-222737 | 8/1994 |
| JP | 09-152850 | 6/1997 |
| JP | 10-083166 | 3/1998 |
| JP | 2000-241797 | 9/2000 |
| KR | 1002293800000 | 8/1999 |
| KR | 239413 | 1/2000 |

* cited by examiner

*Primary Examiner*—Amr A. Awad
*Assistant Examiner*—Abbas Abdulselam
(74) *Attorney, Agent, or Firm*—Rabin & Berdo, PC

(57) ABSTRACT

An apparatus and a method for data signal scattering conversion. The apparatus includes a scattering multiplexer, a digital-to-analog converter, and a scattering demultiplexer. The scattering multiplexer is for receiving p digital data signals and outputting the q-th digital data signal of the p digital data signals. The digital-to-analog converter is to perform digital-to-analog conversion of the q-th digital data signal and output an analog data signal. The scattering demultiplexer has p output terminals, and is used for outputting the analog data signal through the q-th output terminal. Offset voltages output from the digital-to-analog converter are scattered over a number of data lines so that undesired points with abnormally deep or light colors due to the output offset voltages, are difficult to perceive.

29 Claims, 18 Drawing Sheets

522(j)

| | | | | | |
|---|---|---|---|---|---|
| j-5 | j-4 | j-3 | j-2 | j-1 | j |
| j-5 | j-4 | j-3 | j-2 | j-1 | j |
| j-5 | j-4 | j-3 | j-2 | j-1 | j |
| j-5 | j-4 | j-3 | j-2 | j-1 | j |
| j-5 | j-4 | j-3 | j-2 | j-1 | j |
| j-5 | j-4 | j-3 | j-2 | j-1 | j |

FIG. 7A (PRIOR ART)

522(j)

| | | | | | |
|---|---|---|---|---|---|
| j-5 | j-4 | j-3 | j-2 | j-1 | j |
| j-4 | j-3 | j-2 | j-1 | j | j+1 |
| j-3 | j-2 | j-1 | j | j+1 | j+2 |
| j-4 | j-3 | j-2 | j-1 | j | j+1 |
| j-5 | j-4 | j-3 | j-2 | j-1 | j |
| j-4 | j-3 | j-2 | j-1 | j | j+1 |

FIG. 7B

522(j)

| | | | | | |
|---|---|---|---|---|---|
| +(j-5) | -(j-4) | +(j-3) | -(j-2) | +(j-1) | -j |
| +(j-5) | -(j-4) | +(j-3) | -(j-2) | +(j-1) | -j |
| +(j-5) | -(j-4) | +(j-3) | -(j-2) | +(j-1) | -j |
| +(j-5) | -(j-4) | +(j-3) | -(j-2) | +(j-1) | -j |
| +(j-5) | -(j-4) | +(j-3) | -(j-2) | +(j-1) | -j |
| +(j-5) | -(j-4) | +(j-3) | -(j-2) | +(j-1) | -j |

FIG. 12A (PRIOR ART)

522(j)

| | | | | | |
|---|---|---|---|---|---|
| +(j-5) | -(j-4) | +(j-3) | -(-2) | +(j-1) | -j |
| +(j-1) | -j | +(j+1) | -(j+2) | +(j+3) | -(j+4) |
| +(j-3) | -(j-2) | +(j-1) | -j | +(j+1) | -(j+2) |
| +(j-5) | -(j-4) | +(j-3) | -(-2) | +(j-1) | -j |
| +(j-1) | -j | +(j+1) | -(j+2) | +(j+3) | -(j+4) |
| +(j-3) | -(j-2) | +(j-1) | -j | +(j+1) | -(j+2) |

FIG. 12B

522(j-1)

| | | | | | |
|---|---|---|---|---|---|
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |

FIG. 13A

522(j-2) 522(j)

| | | | | | |
|---|---|---|---|---|---|
| +(j-3) | -(j-2) | +(j-1) | -j | +(j+1) | -(j+2) |
| +(j-3) | -(j-2) | +(j-1) | -j | +(j+1) | -(j+2) |
| +(j-3) | -(j-2) | +(j-1) | -j | +(j+1) | -(j+2) |
| +(j-3) | -(j-2) | +(j-1) | -j | +(j+1) | -(j+2) |
| +(j-3) | -(j-2) | +(j-1) | -j | +(j+1) | -(j+2) |
| +(j-3) | -(j-2) | +(j-1) | -j | +(j+1) | -(j+2) |

FIG. 13B

522(j-1)

| | | | | | |
|---|---|---|---|---|---|
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |
| -(j-4) | +(j-3) | -(j-2) | +(j-1) | -j | +(j+1) |

FIG. 13E

APPARATUS AND METHOD FOR DATA SIGNAL SCATTERING CONVERSION

This application incorporates by reference Taiwanese application Serial No. 90109219, filed on Apr. 17, 2001.

BACKGROUND OF THE INVENTION

1. Field of the Invention

The invention relates in general to an apparatus and method for data signal conversion, and more particularly to an apparatus and method for data signal scattering conversion.

2. Description of the Related Art

A display apparatus is used as means of communication between humans and machines. Two kinds of display apparatus, the cathode ray tube (CRT) display and the liquid crystal display (LCD), are available in the market. For CRT displays, since their technology and manufacture are well developed, their cost is relatively low even for providing high quality color images, so that they are widely used. However, CRT displays are large in size and emit high levels of radiation. On the other hand, LCDs can be made more compact, with low emissions of radiation. Therefore, LCDs, such as thin-film transistor liquid crystal displays (TFT-LCDs), are being substituted for CRT displays.

Referring to the block diagram of FIG. 1, a TFT-LCD 100 is illustrated to include a display panel 110, a data driver 120, and a scanning driver 130. Display panel 110 includes a plurality of pixel units P configured to form an m by n array, wherein each pixel unit P includes a thin film transistor and a liquid crystal device (not shown). For the pixel units in each column, source terminals of the thin film transistors are electronically coupled, forming m data lines 122 stretched out within the display panel 110. Likewise, for the pixel units in a row, gate terminals of the thin film transistors are electronically coupled, forming n scan lines 132 stretched out within display panel 110. Data driver 120 includes a front-end processor 126 and a data signal converter 128, and is used to receive digital image data D and output analog data signals A. Front-end processor 126 is employed to receive the digital image data D and output digital data signals D'. Data signal converter 128 is coupled to front-end processor 126 and display panel 110, and is used to receive the digital data signals D', perform digital-to-analog (D/A) conversion of the digital data signals D' so as to produce analog data signals A, and then output them to display panel 110. Scanning driver 130 is coupled to scan lines 132 and is to receive a horizontal synchronization (HSYNC) signal and a vertical synchronization (VSYNC) signal.

According to the VSYNC signal, scanning driver 130 sequentially selects each of the scan lines 132 (scan line 132(*k*), k=1 to n), so as to turn on all the thin film transistors of the selected scan line. When all the thin film transistors of the scan line 132(*k*) are turned on, the analog data signals A from data driver 120 are applied to the liquid crystal devices of the scan line 132(*k*) through source and drain terminals of the thin film transistors of scan line 132(*k*) for control of the gray levels of the liquid crystal devices. In this manner, data driver 120 controls the gray levels of the liquid crystal devices according to the analog data signals A. When scanning driver 130 receives the VSYNC signal, scanning driver 130 re-starts to turn the scan lines 132 sequentially on at a time from the first (k=1) to the last (k=n). Generally, the time period between two successive HSYNC signals is denoted as a horizontal scanning time, while the time period between two successive VSYNC signals is denoted as a vertical scanning time. For displaying a frame, it takes one horizontal scanning time to complete one horizontal line of the frame, and takes one vertical scanning time to complete the entire frame.

In practice, the liquid crystal device is easily damaged when voltages of the same polarity are continuously applied to the liquid crystal devices. Accordingly, data driver 120 may apply polarity inversions to avoid such damage on liquid crystal device. Polarity inversion such as dot inversion or column inversion is to alternately output positive and negative voltages to the liquid crystal devices.

FIG. 2 illustrates details of the data signal converter 128 shown in FIG. 1. Data signal converter 128 includes a digital-to-analog (D/A) converter. The converter 128 receives the digital data signals D', performs polarity inversion of the digital data signals D', and outputs the analog data signals A. The converter 128 includes m demultiplexers 202, m multiplexers 204, m+1 digital-to-analog conversion devices 206, and m+1 output buffers 210. For instance, demultiplexer 202(*i*) is used to receive digital data signal D'(i) and to output digital data signal D'(i) to either D/A conversion device 206(*i*) or 206(i+1) according to the polarity inversion method. If i is an odd number, D/A conversion device 206(*i*) is to output converted data signal S(i) with positive polarity. If i is an even number, D/A conversion device 206(*i*) is to output converted data signal S(i) with negative polarity. Output buffer 210(*i*) is used to receive converted data signal S(i), output buffered data signal S'(i), and feed buffered data signal S'(i) into multiplexers 204(i−1) and 204(*i*). Multiplexer 204(*i*) is employed to receive buffered data signals S'(i) and S'(i+1) from output buffers 210(*i*) and 210(i+1) respectively, and to selectively output digital data signal A(i) according to demultiplexer 202(*i*), where A(i) is either S'(i) or S'(i+1). For example, demultiplexer 202(*i*) outputs digital data signal D'(i) to D/A conversion device 206(i+1) so that multiplexer 204(*i*) outputs S'(i+1) as analog data signal A(i). In this way, by using demultiplexers 202 and multiplexers 204, the polarities of individual analog data signals A can be changed according to the polarity inversion method, and analog data signals A after polarity inversion are associated with appropriate data lines 122. If demultiplexer 202(*i*) and multiplexer 204(*i*) are to change the polarity of analog data signal A(i) according to the HSYNC signal, the dot inversion is therefore achieved. If demultiplexer 202(*i*) and multiplexer 204(*i*) are to change the polarity of analog data signal A(i) according to the VSYNC signal, the effect of column inversion is achieved.

However, the analog data signals from the data driver may have different offset voltages, which correspond to gray lines displayed on the LCD and affects the uniformity of the brightness of each pixel displayed. Generally, the data driver produces the offset voltages due to variations of output voltage levels of the operational amplifiers in output buffers 210. The offset of output voltage level of an operational amplifier is commonly in the range of 50 mV to 60 mV, while offset voltage tolerated by the LCD is within 10 mV. If the offset in the output of the operational amplifier exceeds the tolerance by too much, the associated liquid crystal device of display panel 110 may become a pixel unit with undesired deep color or light color.

FIG. 3A illustrates a frame 300 displayed by TFT-LCD 100, wherein each rectangle represents a pixel unit and the output buffer 210(*j*) has an output offset voltage. Output buffer 210(*j*) outputs analog data signal A(j) to data line 122(*j*) so that the pixel units controlled by data line 122(*j*) displays a light gray line. FIG. 3B shows a graph of gray level intensity versus data line, wherein the data lines shown in FIG. 3A are indicated along the X-axis, while the gray level intensities perceived by humans are measured along the Y-axis, and wherein data driver 120 outputs image data by the column inversion method. Since light stimulus will be integrated in the human visual system, the gray line corresponding to output buffers 210(*j*) occurs as shown in FIG. 3A.

FIG. 4A illustrates another frame 400 displayed by the TFT-LCD 100, wherein each rectangle represents one pixel unit and data driver 120 outputs image data by the dot inversion. Output buffer 210(*j*) has an output offset voltage. Thus, when output buffer 210(*j*) outputs analog data signal A(j) to data line 122(*j*) or outputs analog data signal A(j−1) to data line 122(j−1), the pixel units controlled by data lines 122(*j*) and 122(j−1) displays light gray points indicated in FIG. 4A. By the integration effect of the human visual system described above, these light gray points are actually perceived by humans as light gray lines displayed on the LCD panel, as shown in FIG. 4B. The X-axis in FIG. 4B indicates the data lines of FIG. 4A while the Y-axis indicates the gray level intensities perceived by human eyes.

For resolving the problem of degradation of the uniformity of display brightness due to the variation in output signal level, one way is to improve the output precision of the operational amplifiers to be used. However, this solution greatly increases the difficulty in the design and manufacture of LCDs.

SUMMARY OF THE INVENTION

It is therefore an object of the invention to provide an apparatus and a method for data signal scattering conversion. By the invention, the degradation of uniformity of brightness that on a display can be effectively avoided.

This object of the invention of the invention is satisfied by an apparatus for data signal scattering conversion for use in a display with signal scattering conversion. A display with signal scattering includes a display panel and a data driver. The display panel includes multiple pixel units, wherein the pixel units are arranged to form an m by n array. The pixel units on each row are electrically coupled, forming a scan line; the pixel units on each column are electrically coupled, forming a data line. The data driver, coupled to the display panel, is used for outputting m analog data signals to the pixel units according to digital image data. The data driver includes a front-end processing device and the apparatus for data signal scattering conversion. The front-end processing device is used for receiving the digital image data and outputting m digital data signals. The apparatus for data signal scattering conversion is used for receiving the digital data signals and outputting the m analog data signals to the pixel units. The apparatus for data signal scattering conversion includes a scattering multiplexer, a digital-to-analog converter, and a scattering demultiplexer. The scattering multiplexer is for receiving p digital data signals and outputting the q-th digital data signal of the p digital data signals by a scattering method, wherein p and q are positive integers and q is not greater than p. The digital-to-analog converter is coupled to the scattering multiplexer, and is used for performing digital-to-analog conversion of the q-th digital data signal and outputting an analog data signal. The scattering demultiplexer is coupled to the digital-to-analog converter, has p output terminals, and is employed to output the analog data signal through the q-th output terminal by the scattering method.

Since the output buffers of the digital-to-analog converter may have different output offset voltages due to the variations in the output voltage levels of the individual output buffers, light gray lines associated with the output buffers will be formed on the display. According to the invention, the relation between the D/A converter's output buffers and the data lines is changed. Thus, the effect of the output offset voltages of the digital-to-analog converter on individual data lines is scattered over a number of data lines, so that undesired points with abnormally deep or light colors due to this effect are almost imperceptible on the display.

According to the object of the invention, a method for image display with signal scattering is provided for use in a display, wherein the display includes a plurality of pixel units arranged to form an m by n array. The method includes the following steps. First, p digital data signals are provided. Next, according to a scattering method, the q-th digital data signal is selected from the p digital data signals. According to the q-th digital data signal, an analog data signal is then produced. Finally, according to the scattering method, the analog data signal is fed into the pixel unit of the r-th row, q-th column for image formation, wherein m, n, p, q, and r are positive integers, q is not greater than p, and r is not greater than m.

Other objects, features, and advantages of the invention will become apparent from the following detailed description of the preferred but non-limiting embodiments. The following description of the invention is made with reference to the accompanying drawings.

BRIEF DESCRIPTION OF THE DRAWINGS

FIG. 7A (Prior Art) illustrates a displayed frame with a gray line.

FIG. 7B illustrates a frame displayed by using a method of space scattering according to a preferred embodiment of the invention.

FIG. 12A (Prior Art) illustrates a displayed frame with a gray line.

FIG. 12B illustrates a frame displayed by application of a space scattering method according to a preferred embodiment of the invention.

FIGS. 13A–13E illustrate successive frames displayed by application of a time scattering method.

DESCRIPTION OF THE PREFERRED EMBODIMENT

Figure 1:
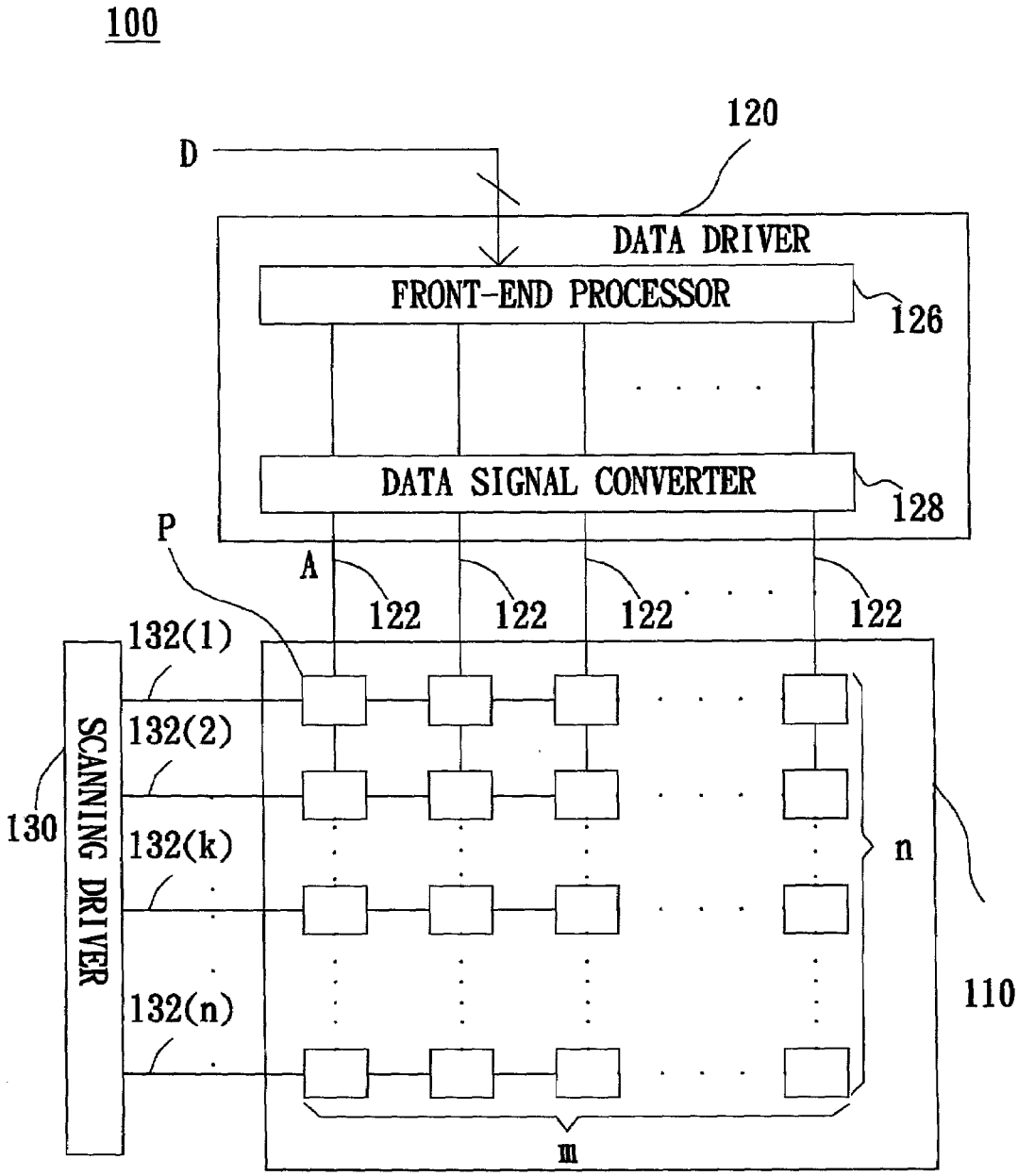
FIG. 1 (PRIOR ART)
FIG. 1 (Prior Art) is a block diagram illustrating a TFT-LCD.
Figure 2:
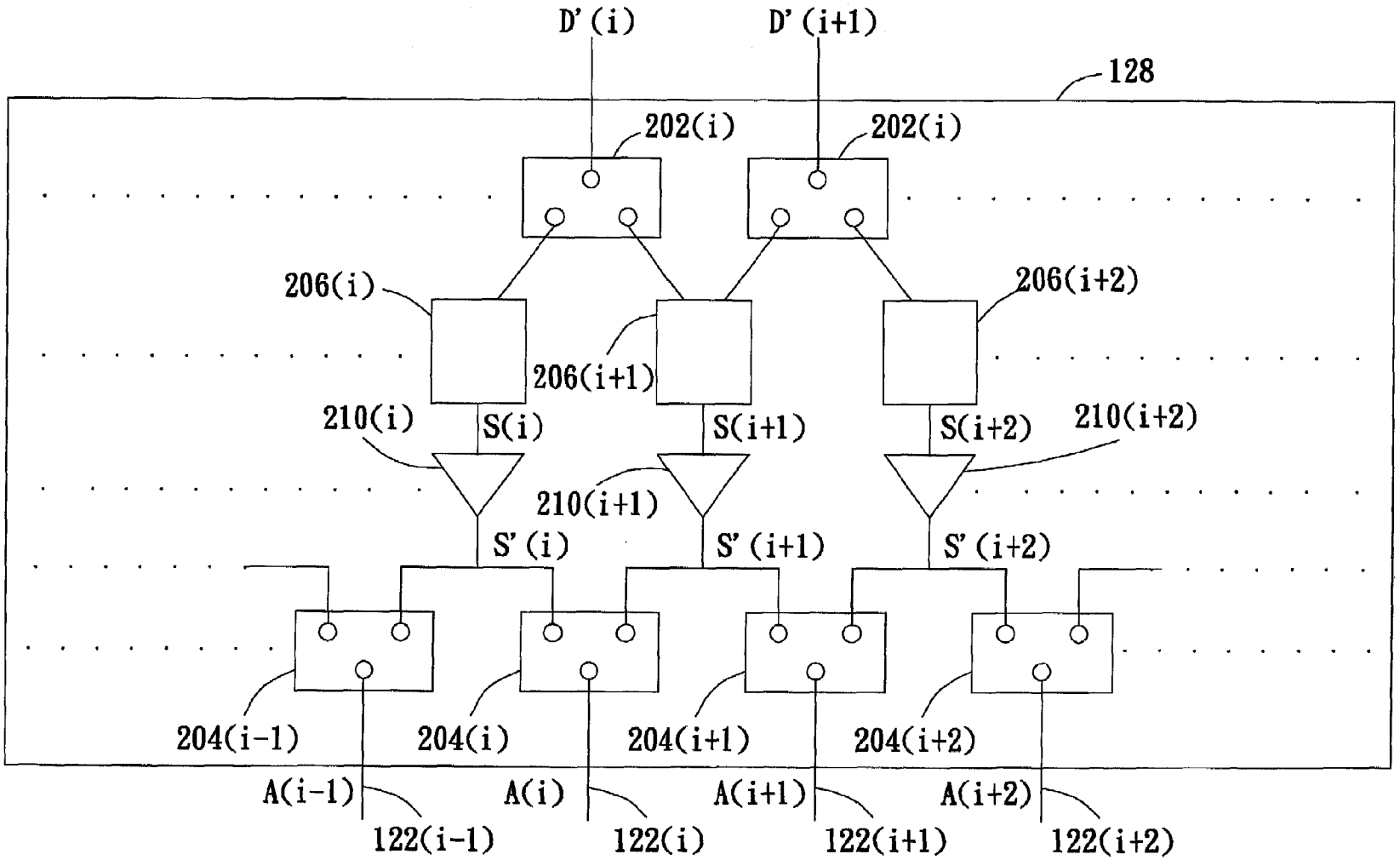
FIG. 2 (PRIOR ART)
FIG. 2 (Prior Art) is a block diagram illustrating the data signal converter shown in FIG. 1.
Figure 3A:
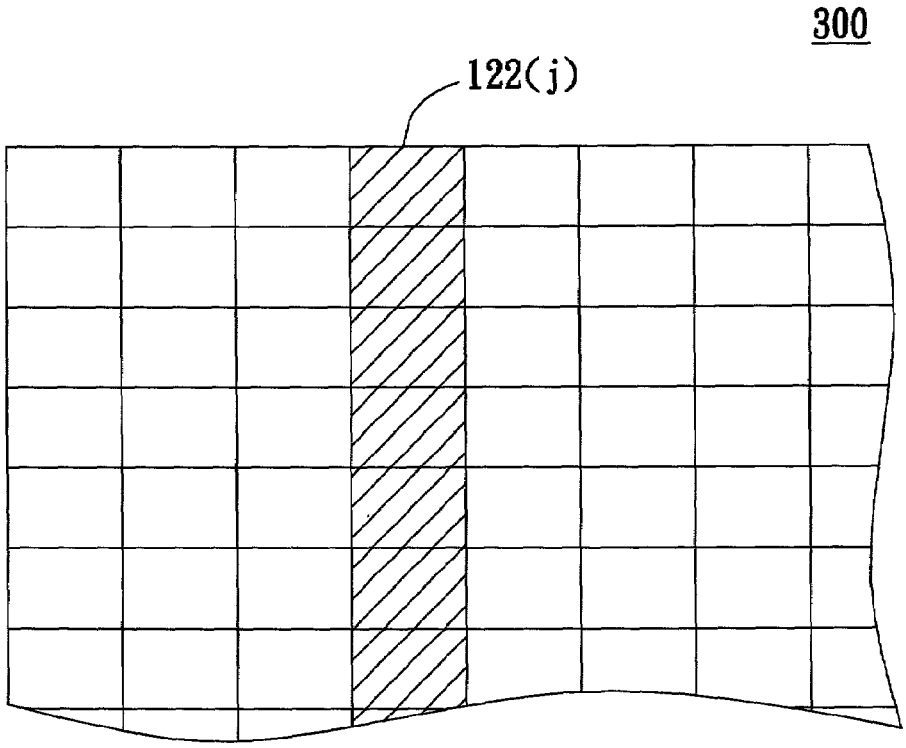
FIG. 3A (PRIOR ART)
FIG. 3A (Prior Art) illustrates a frame displayed by the LCD.
Figure 3B:
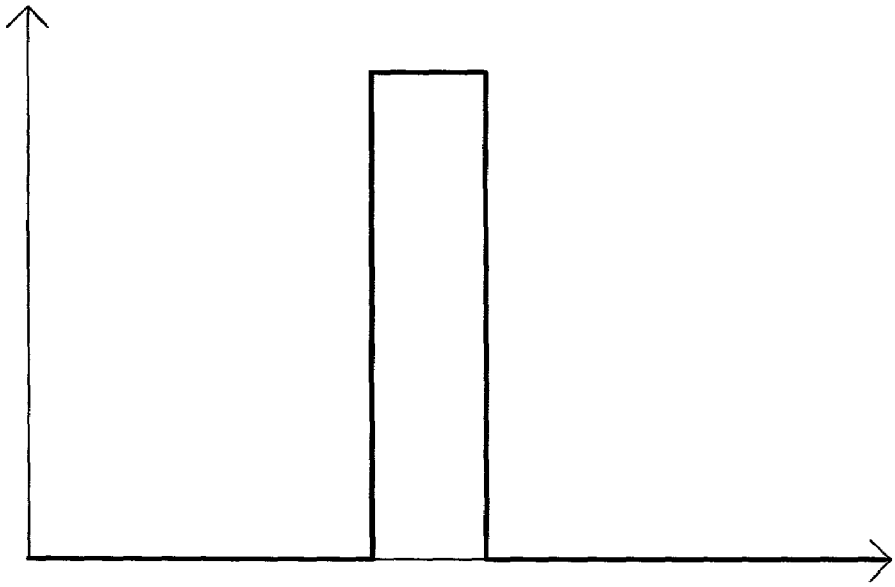
FIG. 3B (PRIOR ART)
FIG. 3B (Prior Art) is a graph of gray level intensity versus data line for the frame shown in FIG. 3A.
Figure 4A:
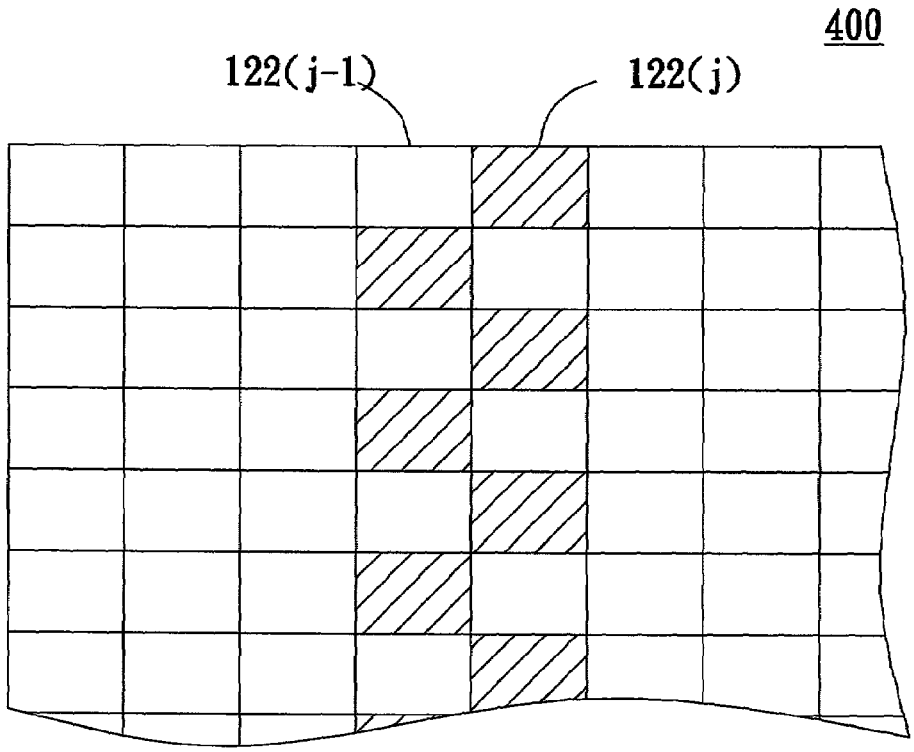
FIG. 4A (PRIOR ART)
FIG. 4A (Prior Art) illustrates another frame displayed by the LCD.
Figure 4B:
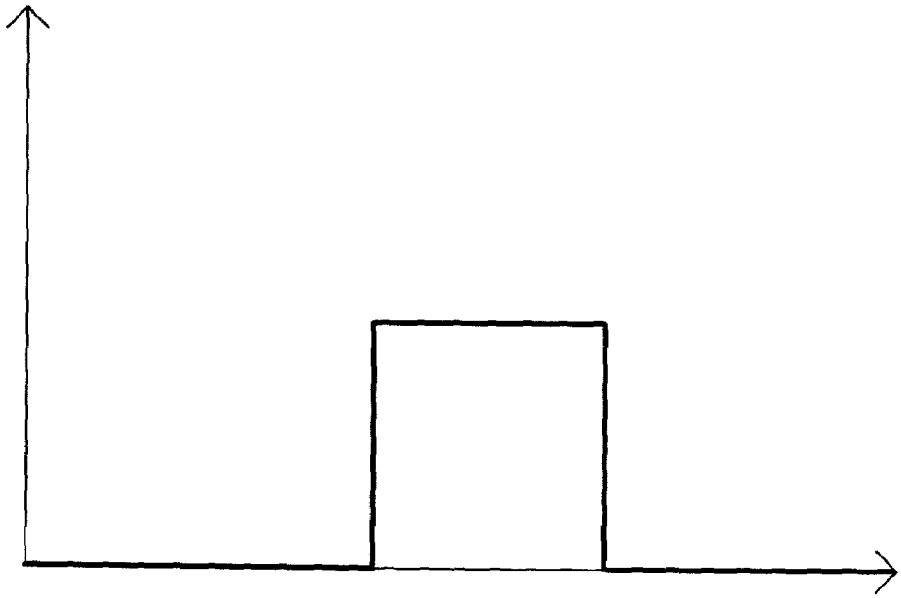
FIG. 4B (PRIOR ART)
FIG. 4B (Prior Art) is a graph of gray level intensity for the frame shown in FIG. 4A.
Figure 5:
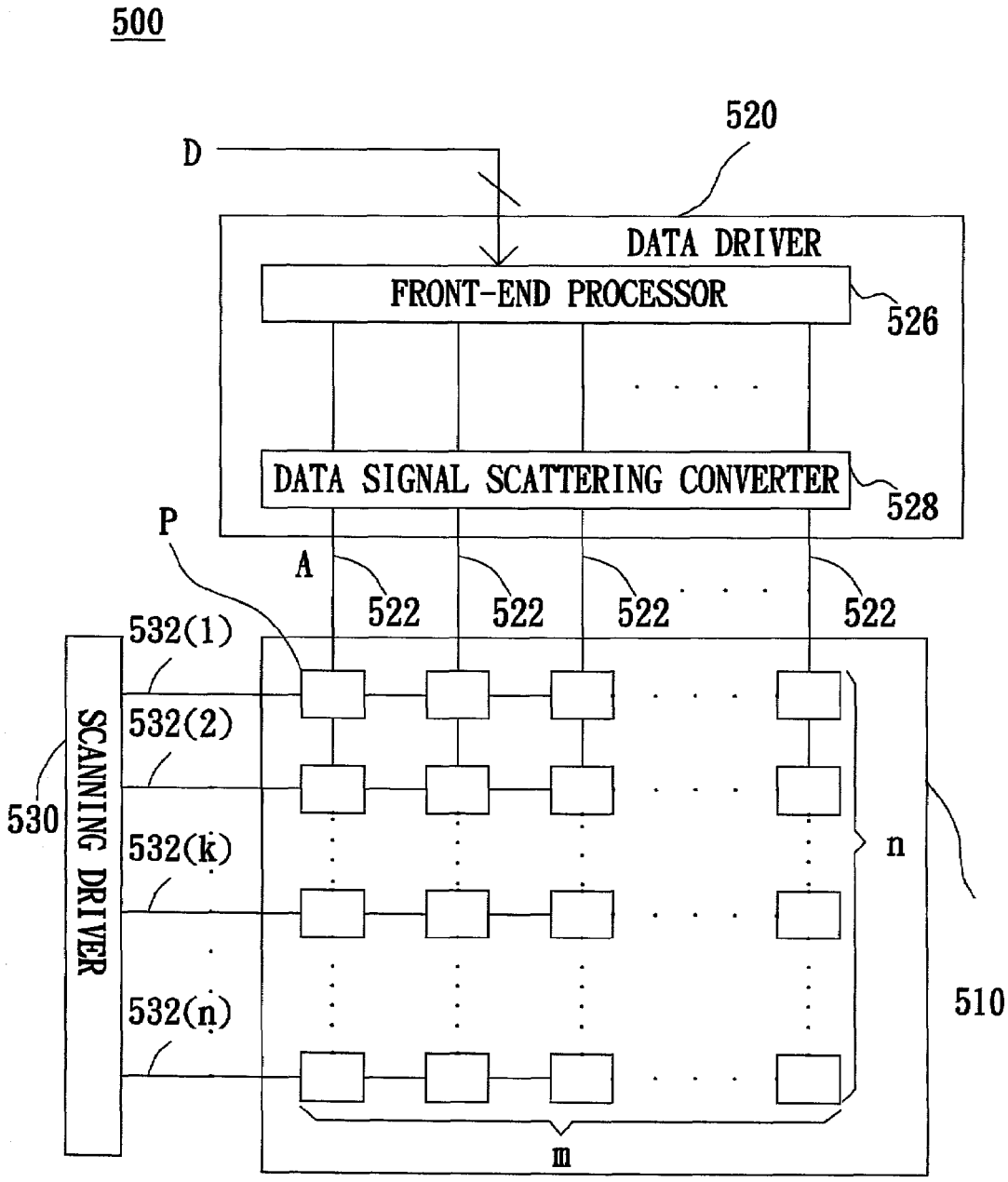
FIG. 5 illustrates a display apparatus with signal scattering conversion according to a preferred embodiment of the invention.

Referring to FIG. 5, it shows a block diagram illustrating a display apparatus with signal scattering conversion according to a preferred embodiment of the invention. Display apparatus with signal scattering conversion 500 includes display panel 510, data driver 520, and scanning driver 530. Display panel 510 includes a plurality of pixel units P configured to form an m by n array, wherein each pixel unit P includes a thin film transistor and a liquid crystal device. For the pixel units in each column, source terminals of the thin film transistors are coupled electronically, forming m data lines 522 stretched out in the display panel 510. Likewise, for the pixel units in a row, gate terminals of the thin film transistors are coupled electronically, forming n scan lines 532 stretched out in display panel 510. Data driver 520 includes front-end processor 526 and data signal scattering converter 528, and is used to receive digital image data D and output analog data signals A. Front-end processor 526 is employed to receive the digital image data D and output digital data signals D'. Data signal scattering converter 528 is coupled to front-end processor 526 and data lines 522, and is used to receive the digital data signals D', perform digital-to-analog (D/A) conversion of the digital data signals D' so as to produce analog data signals A, and output them to data lines 522. Scanning driver 530 is coupled to scan lines 532 and is to receive a horizontal synchronization (HSYNC) signal and a vertical synchronization (VSYNC) signal.

According to the VSYNC signal, scanning driver 530 selects one of scan lines 532, such as scan line 532(*k*), sequentially, where k is an positive integer not greater than n, so that all of the thin film transistors of the scan line are turned on. When all the thin film transistors of scan line 532(*k*) are turned on, the analog data signals A from data driver 520 can be applied to the liquid crystal devices of scan line 532(*k*) through source and drain terminals of the thin film transistors of scan line 532(*k*), whereby data driver 520 controls the liquid crystal device in gray scales according to the analog data signals A. When scanning driver 530 receives the VSYNC signal, scanning driver 530 re-starts to turn on one of scan lines 532 sequentially from the first one.

Figure 6:
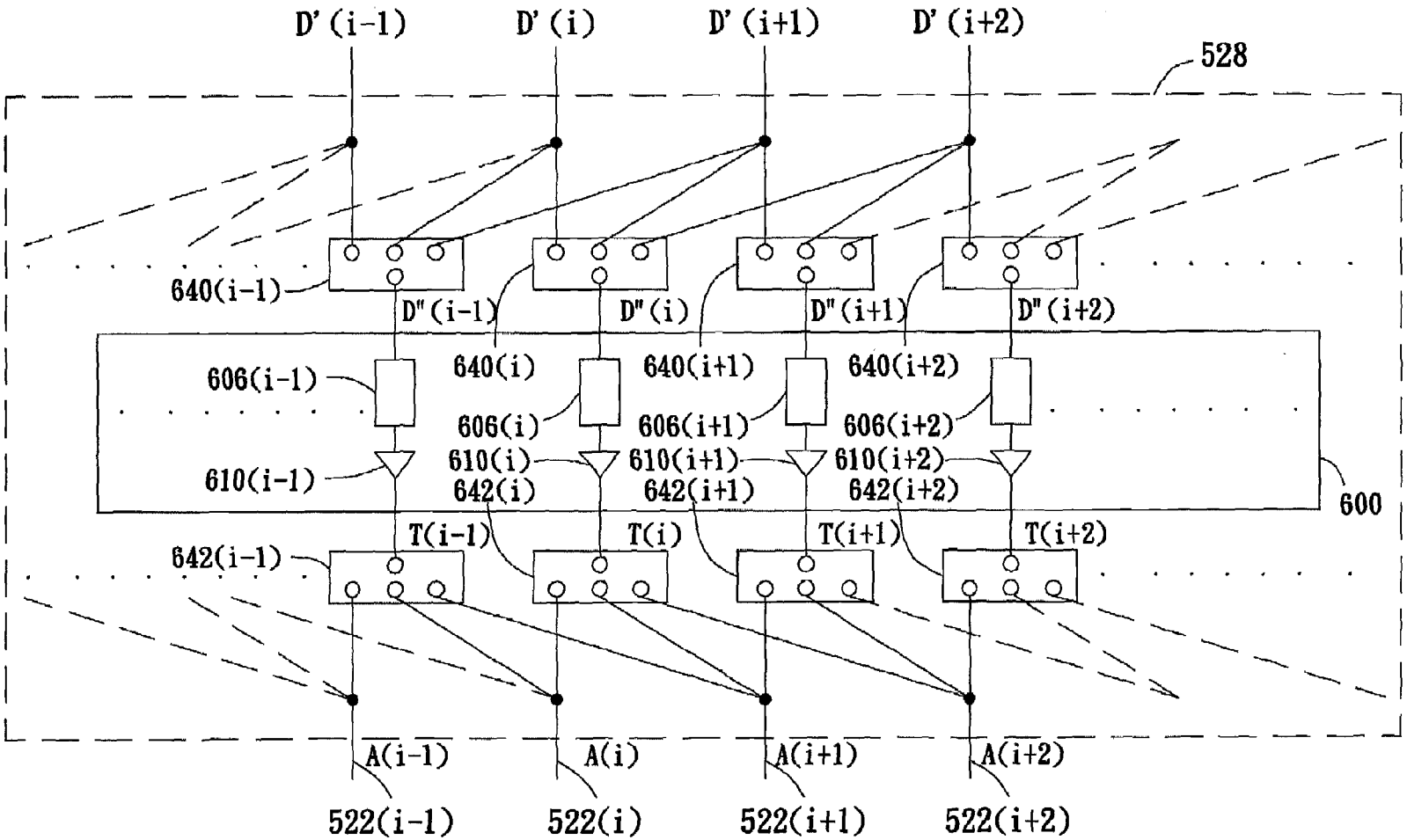
FIG. 6 is a block diagram illustrating the data signal scattering converter in FIG. 5.

FIG. 6 is a block diagram of the data signal scattering converter 528 of FIG. 5. Data signal scattering converter 528 includes digital-to-analog (D/A) converter 600, scattering multiplexers 640, and scattering demultiplexers 642. In this embodiment, scattering multiplexers 640 are 3-to-1-line multiplexers; that is, each of them has three input terminals and one output terminal. Besides, scattering demultiplexers 642 are 1-to-3-line demultiplexers; that is, each of them has one input terminal and three output terminals. In practice, at least 2-to-1-line multiplexers and 1-to-2-line demultiplexers can act as the scattering multiplexers and scattering demultiplexers, respectively, according to the invention. Scattering multiplexer 640(*i*) is used to receive digital data signals D'(i), D'(i+1) and D'(i+2), and, according to a scattering method to be described later, select one out of digital data signals D'(i), D'(i+1) and D'(i+2) as scattering data signal D"(i). Digital-to-analog converter 600 is coupled to scattering multiplexers 640, and is used to receive scattering data signals D", perform digital-to-analog conversion on scattering data signals D", and output analog data signals T. Digital-to-analog converter 600 includes digital-to-analog conversion devices 606 and output buffers 610, and is used to output analog data signals T. Digital-to-analog conversion devices 606 are coupled to scattering multiplexers 640, while output buffers 610 are coupled to digital-to-analog conversion devices 606. Scattering demultiplexer 642(*i*), coupled to D/A converter 600, is used to receive analog data signal T(i) and to output analog data signal T(i) to one of data lines 522(*i*), 522(i+1), and 522(i+2) according to scattering multiplexers 640. For instance, if scattering data signal D"(i) from scattering multiplexers 640 is digital data signal D'(i+2) so that analog data signal T(i) is equal to analog data signal A(i+2), scattering demultiplexers 642 output analog data signal T(i) to data line 522(i+2). In this way, analog data signals A can be associated with data lines 522 correctly. Besides, all scattering multiplexers 640 are synchronized; that is, if scattering multiplexer 640(*i*) selects digital data signal D'(i+2) and outputs it as scattering data signal D"(i), scattering multiplexer 640(i−1) selects digital data signal D'(i+1) as scattering data signal D"(i−1).

Through the operation of scattering multiplexers 640 and scattering demultiplexers 642, each output of the output buffers of D/A converter 600 is to be scattered over three data lines. Therefore, if some of the output buffers have output offset voltages, undesired points due to the output offset voltages will be scattered within the three data lines. Since the scattered undesired points cannot form light gray lines on the display and they are almost imperceptible, the display quality is improved.

By the invention, a scattering method is used to change the correspondence between output buffers 610 and data lines 522. Undesired points with abnormally deep or light colors due to output offset voltages from output buffers 610 are scattered according to the scattering method so that the undesired points are almost imperceptible. Hence, the degradation of uniformity of display brightness can be reduced effectively. The scattering method can be space scattering, time scattering, or time-and-space scattering, for example.

Space scattering is used to change the relation between output buffers 610 and data lines 522 for each horizontal line. Referring to FIG. 7A, it illustrates a frame displayed without using the scattering method. In FIG. 7A, each of the rectangles represents one pixel unit, and the numbers in the rectangles indicate corresponding output buffers that apply gray level voltages to the pixel units. When the pixel unit is drawn as a shaded rectangle, an output buffer corresponding to the number in the shaded rectangle for that pixel unit has an output offset voltage. As can be observed from FIG. 7A, output buffer j has an output offset voltage so that a light gray line is formed through data line 522(*j*). Referring now to FIG. 7B, it illustrates a frame displayed by using space scattering, wherein output buffer 610(*j*) has an output offset voltage. Besides, scattering multiplexer 640(*j*) successively selects digital data signals D' in the sequence D'(j), D'(j+1), D'(j+2), D'(j+1), D'(j), D'(j+1), and so on. When the scattering data converter receives the HSYNC signal, the relation between output buffers 610 and data lines 522 is changed; that is, undesired points having originally occurred on the same line of a frame are scattered over different data lines of the same frame so that they are difficult to perceive.

Figure 8A:
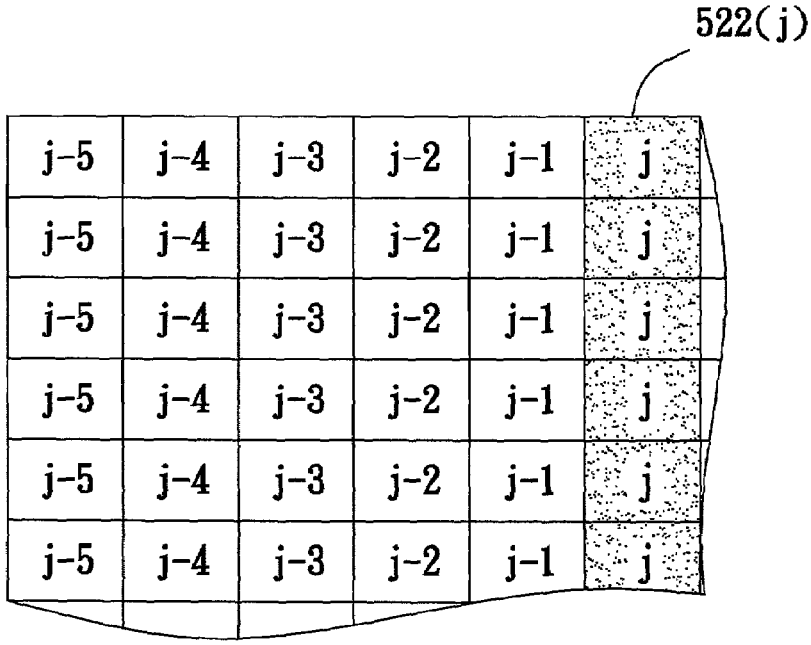
FIGS. 8A–8D illustrate a successive frames displayed by applying a time scattering method.
Figure 8B:
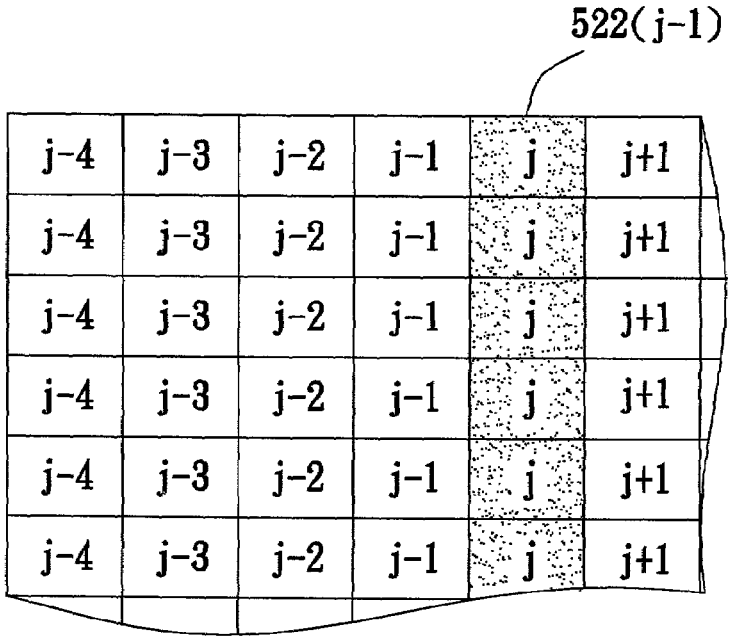
Figure 8C:
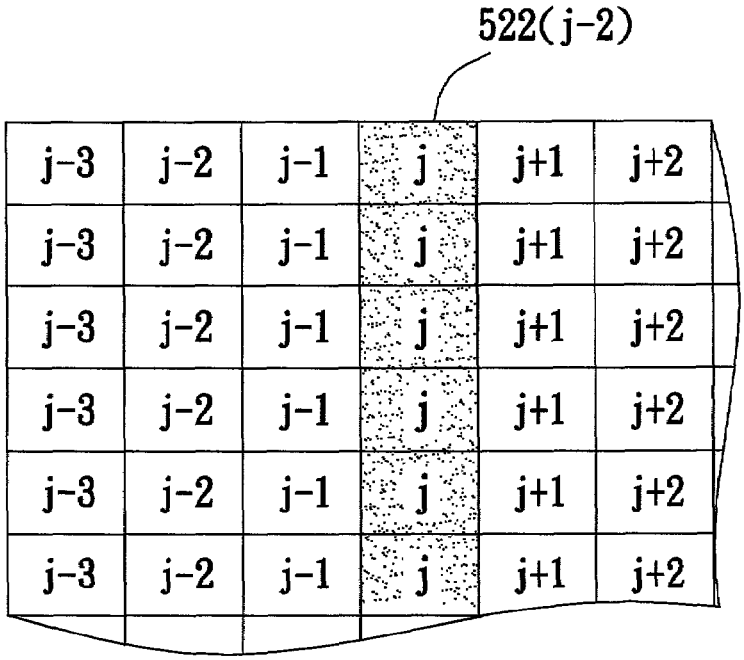
Figure 8D:
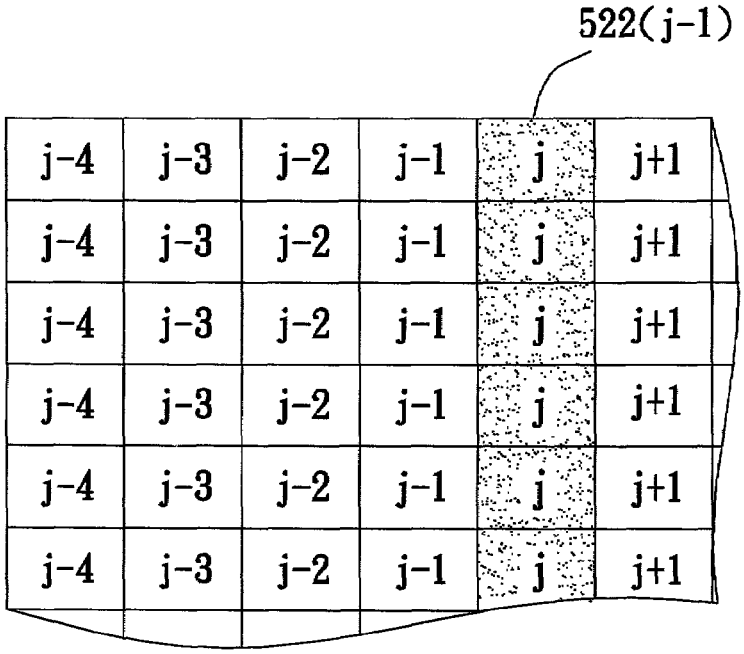
Figure 9A:
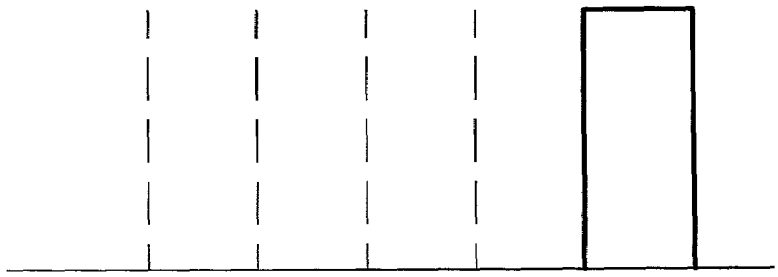
FIGS. 9A–9D are graphs of gray level intensity for the frames shown in FIGS. 8A–8D.
Figure 9B:
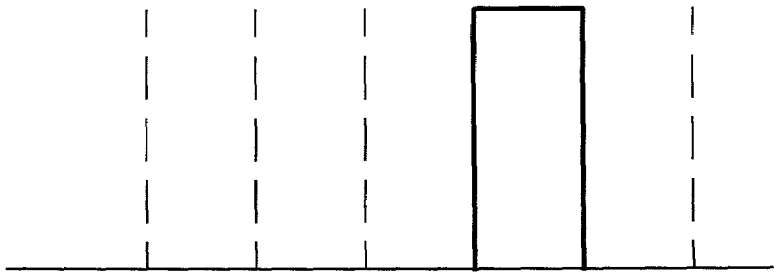
Figure 9C:
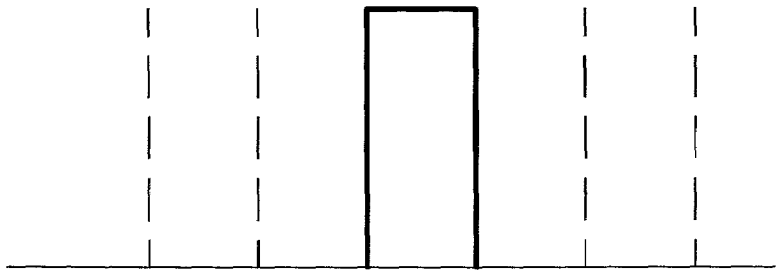
Figure 9D:
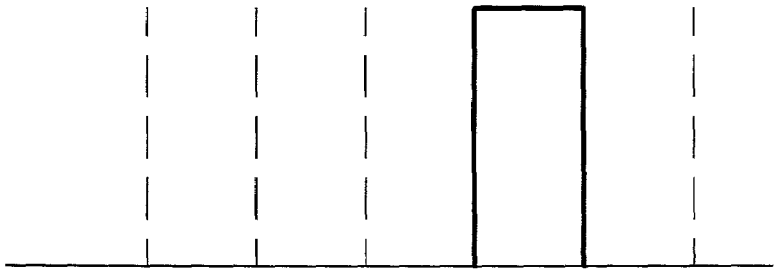

Time scattering is used to change the relation between output buffers 610 and data lines 522 for each frame. Referring to FIGS. 8A to 8D, they illustrate a series of frames displayed by using time scattering, wherein output buffer 610(*j*) has an output offset voltage. Besides, scattering multiplexer 640(*j*) successively selects digital data signals D' in the sequence D'(j), D'(j+1), D'(j+2), D'(j+1), D'(j), D'(j+1), and so on. FIG. 8A illustrates the first frame, where one vertical line with light gray color is formed associated with data line 522(*j*). FIG. 8B illustrates the second frame, where one vertical line with light gray color is formed associated with data line 522(j−1). FIG. 8C illustrates the third frame, where one vertical line with light gray color is formed associated with data line 522(j−2). FIG. 8D illustrates the fourth frame, where one vertical line with light gray color is formed associated with data line 522(j−1). In brief, output buffer 610(*j*) is associated with a different data line for each of the successive frames. Thus, the light gray lines due to output offset voltages are scattered so that they are difficult to perceive.

Time-and-space scattering is used to change the relation between output buffers 610 and data lines 522 for each frame with each horizontal line. That is, undesired points originally associated with the same data line for one frame can be scattered over different frames and different data lines. Thus, the undesired points caused by the output offset voltages of output buffers 610 are scattered equally and are almost imperceptible.

Figure 10:
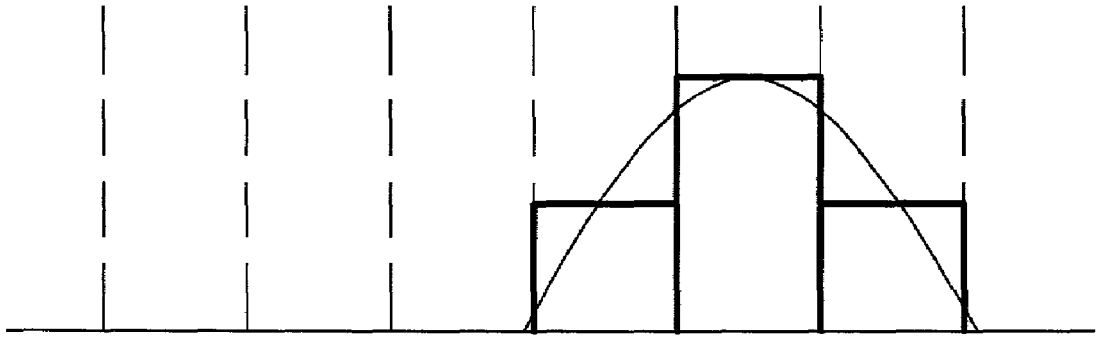
FIG. 10 is a graph of gray level intensity perceived by humans for the frames shown in FIGS. 8A–8D.

Scattering multiplexer 640(*j*) can be configured to select one out of digital data signals D'(j), D'(j+1), and D'(j+2) according to a predetermined sequence, a random sequence, or a weighted curve. In the case of a weighted curve, digital data signals D' outputted to scattering multiplexer 640(*j*) are associated with different weight values respectively. In this way, scattering multiplexer 640(*j*) selects one out of digital data signals D'(j), D'(j+1), and D'(j+2) according to their associated weight values so as to change the relation between output buffers 610 and data lines 522. If scattering multiplexer 640(*j*) changes the relation between output buffers 610 and data lines 522 according to a weighted curve, the display to be perceived is equivalent to the result of convolving the weighted curve with the light gray intensities. For example in FIGS. 8A to 8D, digital data signals D'(j), D'(j+1), and D'(j+2) are associated with weight values ¼, ⅔, and ¼ respectively. Referring to FIGS. 9A to 9D, they shows graphs of gray level intensity for the frames shown in FIGS. 8A–8D respectively. FIG. 10 is a graph of gray level intensity perceived by humans for the successively; equivalently frames shown in FIGS. 8A–8D, this graph shows the result of convolving the weighted curve with gray level intensity of a light gray line. In this way, the undesired points are scattered so that their gray level intensities as perceived by humans, are reduced. Besides, as can be seen from FIG. 10, the gray level intensities are distributed in such a way that the line in the middle has higher intensity than the lines on the both sides. As a whole, the image looks smoother while the undesired points are difficult to perceive. Thus, the display quality is improved.

Figure 11:
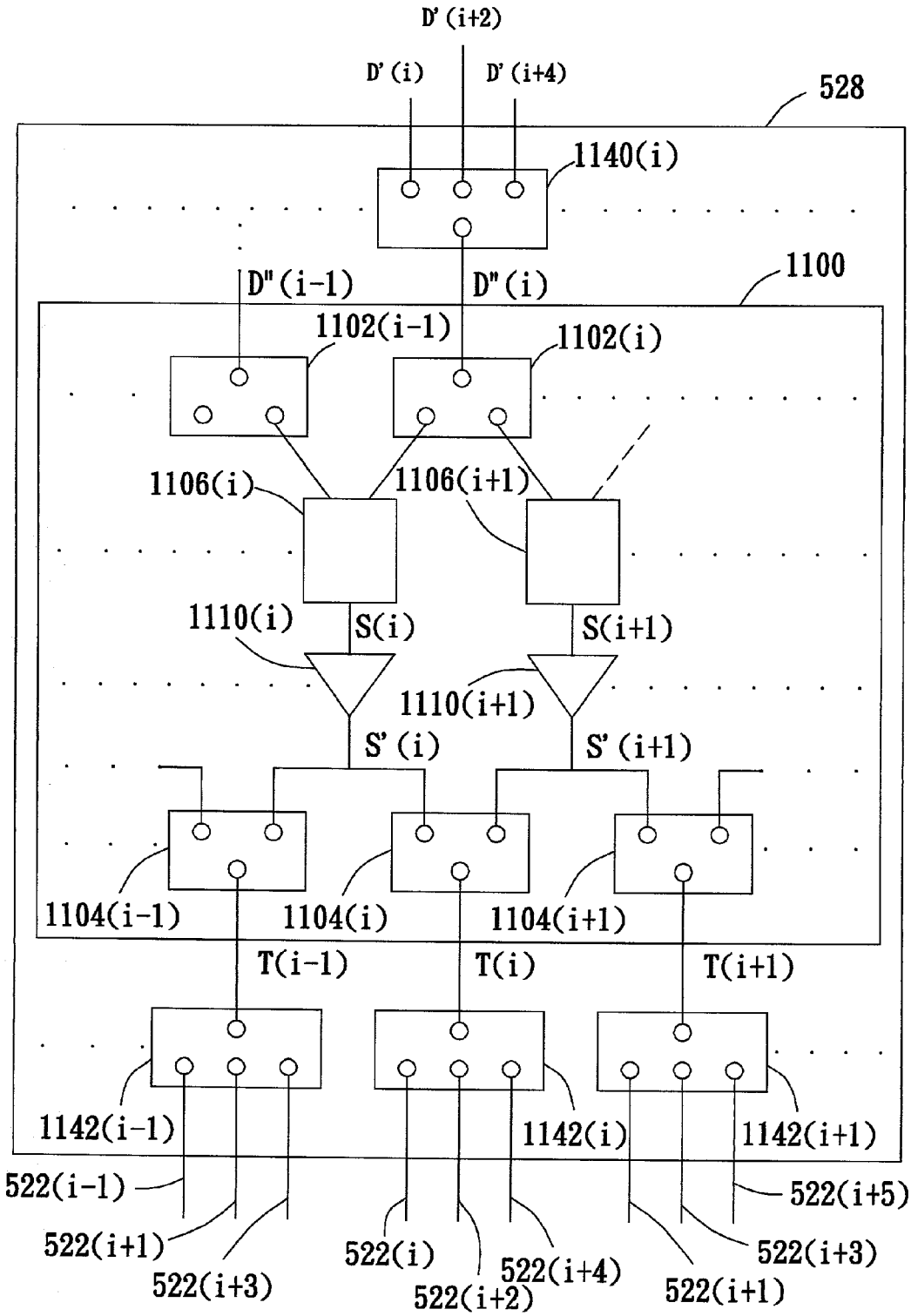
FIG. 11 is a block diagram illustrating another example of data signal scattering converter 528 in FIG. 5.

Referring to FIG. 11, it shows a block diagram of another example of the data signal scattering converter 528 of FIG. 5. In FIG. 11, the data signal scattering converter is capable of outputting analog data signals with different polarities. Data signal scattering converter 528 includes digital-to-analog (D/A) converter 1100, (m+3) scattering multiplexers 1140 serving as selected devices, and (m+3) scattering demultiplexers 1142. In this embodiment, scattering multiplexers 1140 are 3-to-1-line multiplexers; that is, each of them has three input terminals and one output terminal. Besides, scattering demultiplexers 1142 are 1-to-3-line demultiplexers; that is, each of them has one input terminal and three output terminals. In practice, at least 2-to-1-line multiplexers and 1-to-2-line demultiplexers can act as the scattering multiplexers and scattering demultiplexers, respectively, according to the invention. Scattering multiplexer 1140(*i*) is used to receive digital data signals D'(i), D'(i+2) and D'(i+4), and, according to a scattering method be described later, select one out of digital data signals D'(i), D'(i+2) and D'(i+4) as scattering data signal D"(i). Digital-to-analog converter 1100 is coupled to scattering multiplexers 1140, and is used to receive scattering data signals D", perform digital-to-analog conversion on scattering data signals D", and output analog data signals T. Scattering demultiplexer 1142(*i*), coupled to D/A converter 1100, is used to receive analog data signal T(i) and output analog data signal T(i) to one of data lines 522(*i*), 522(i+2), and 522(i+4) according to scattering multiplexers 1140. For instance, if scattering data signal D"(i) from scattering multiplexers 1140 is digital data signal D'(i+2), then analog data signal T(i) is equal to analog data signal A(i+2) and scattering demultiplexers 1142 outputs analog data signal T(i) to data line 522(i+2). In this way, analog data signals A can be associated with data lines 522 correctly. Besides, all scattering multiplexers 1140 are synchronized; that is, if scattering multiplexer 1140(*i*) selects digital data signal D'(i+2) and outputs it as scattering data signal D"(i), scattering multiplexer 1140(i−1) selects digital data signal D'(i+1) as scattering data signal D"(i−1).

Digital-to-analog converter 1100 includes demultiplexers 1102 serving as selected devices, multiplexers 1104 serving as selected devices, D/A conversion devices 1106, and output buffers 1110. Demultiplexer 1102(*i*) is coupled to scattering multiplexer 1140(*i*), D/A conversion device 1106(*i*), and 1106(i+1), and is used to receive scattering data signal D"(i). In addition, according to either dot inversion or column inversion, demultiplexer 1102(*i*) outputs the received scattering data signal D"(i) to either D/A conversion device 1106(*i*) or D/A conversion device 1106(i+1). Further, all demultiplexers 1102(*i*) are synchronized. That is, if demultiplexer 1102(*i*) outputs scattering data signal D"(i) to D/A conversion device 1106(i+1), demultiplexer 1102(i−1) outputs scattering data signal D"(i+1) to D/A conversion device 1106(*i*). Digital-to-analog conversion device 1106(*i*) is coupled to demultiplexers 1102(*i*) and 1102(i−1), and used to receive D"(i−1) or D"(i) and output converted data signal S(i). In addition, if i is an odd number, D/A conversion device 1106(*i*) is to output converted data signal S(i) with positive polarity; if i is an even number, D/A conversion device 1106(*i*) is to output converted data signal S(i) with negative polarity. Output buffer 1110(*i*), coupled to D/A conversion device 1106(*i*), is used to receive converted data signal S(i), output buffered data signal S'(i) according to converted data signal S(i), and feed buffered data signal S'(i) into multiplexers 1104(*i*) and 1104(i−1). Multiplexer 1104(*i*) is coupled to output buffers 1110(*i*) and 1110(i+1), and is used to receive buffered data signals S'(i) and S'(i+1), and to output analog data signal T(i) according to demultiplexer 1102(*i*), wherein analog data signal T(i) is either S'(i) or S(i+1). For instance, when demultiplexer 1102(*i*) outputs scattering data signal D"(i) to D/A conversion device 1106(i+1), multiplexer 1104(*i*) outputs buffered data signal S'(i+1) as analog data signal T(i).

Through the operation of scattering multiplexers 1140, demultiplexers 1102, scattering demultiplexers 1142, and multiplexers 1104, the output of output buffer 1110(*i*) is scattered over six data lines, 522(i−1) to 522(i+4). Therefore, if output buffer 1110(*i*) has an output offset voltage, the undesired points due to the output offset voltage are scattered within the six data lines. Since the scattered undesired points cannot form light gray lines on the display and are humanly almost imperceptible, the display quality is improved.

By the invention, a scattering method is used to change the relation between output buffers 1110 and data lines 522. Thus, undesired points with abnormally deep or light colors due to output offset voltages from output buffers 1110 are scattered so that the undesired points are almost imperceptible. Hence, the degradation of uniformity of display brightness can be reduced effectively. The scattering methods including space scattering, time scattering, and time-and-space scattering are described as follows.

Space scattering is used to change the relation between output buffers 1110 and data lines 522 for each horizontal line. Referring to FIG. 12A, it illustrates a frame displayed without using a scattering method, wherein polarity inversion, such as column inversion, is employed. In FIG. 12A, each of the rectangles represents one pixel unit while the numbers in the rectangles show the corresponding output buffer, which outputs the gray level to the corresponding pixel unit. In addition, signs preceding the numbers in the rectangles are indicative of the polarities of output signals from the output buffers associated with the numbers. When the pixel unit is drawn as a shaded rectangle, an output buffer corresponding to the number in the rectangle has an output offset voltage. As can be observed from FIG. 12A, output buffer 1110(*j*) has an output offset voltage so that a light gray line is formed through data line 522(*j*). Referring now to FIG. 12B, it illustrates a frame displayed by using space scattering, wherein output buffer 1110(*j*) has the output offset voltage. Scattering multiplexer 1140(*j*) successively selects digital data signals D' in the sequence D'(j), D'(j+4), D'(j+2), D (i), D'(j+4), D'(j+2), and so on. When the scattering data converter receives the HSYNC signal, the relation between output buffers 1110 and data lines 522 is changed; that is, undesired points which originally occur on the same line of a frame are scattered over different data lines of the same frame so that they are difficult to perceive.

Figure 13C:
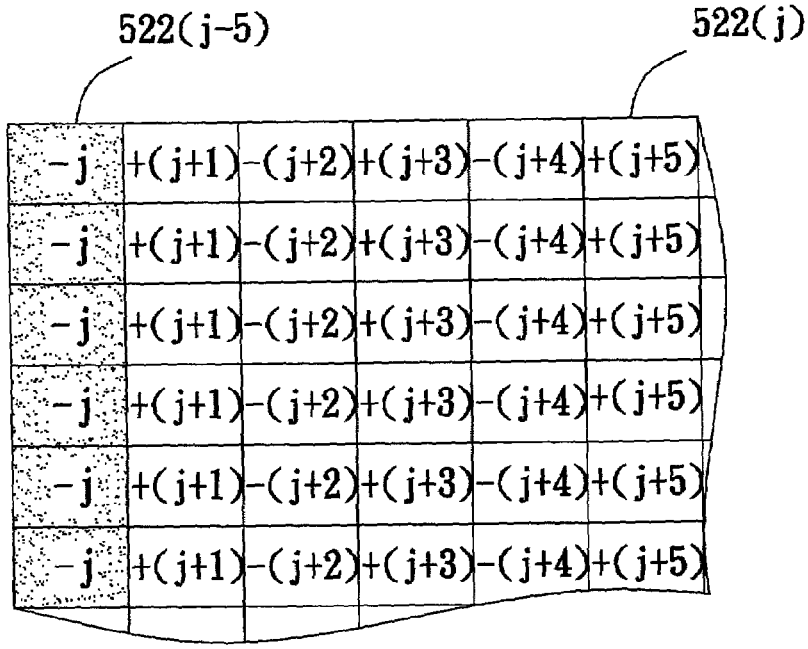
Figure 13D:
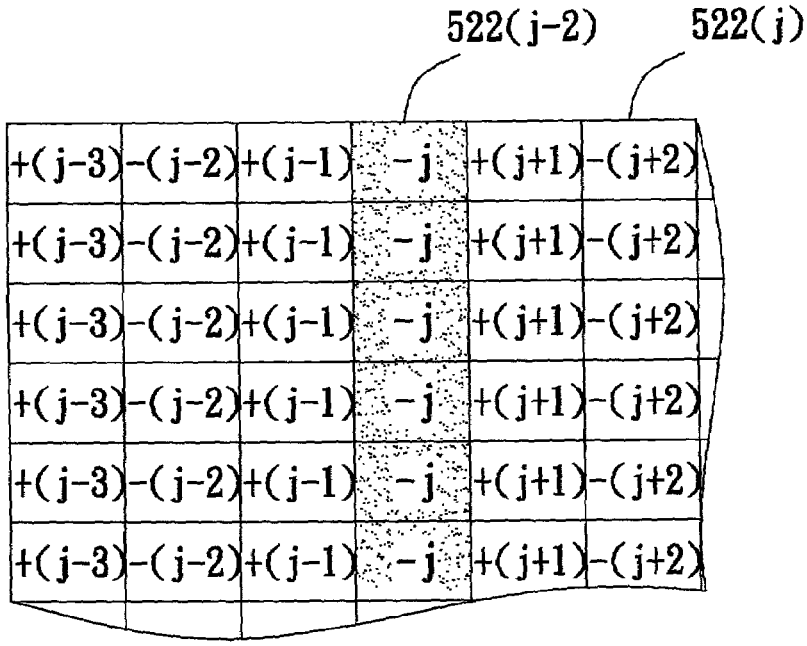
Figure 14A:
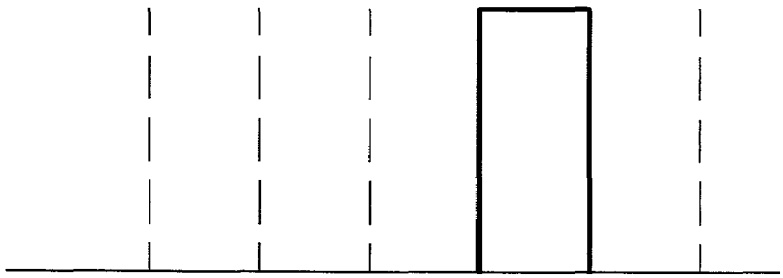
FIGS. 14A–14D are graphs of gray level intensity for the frames shown in FIGS. 13A–13D.
Figure 14B:
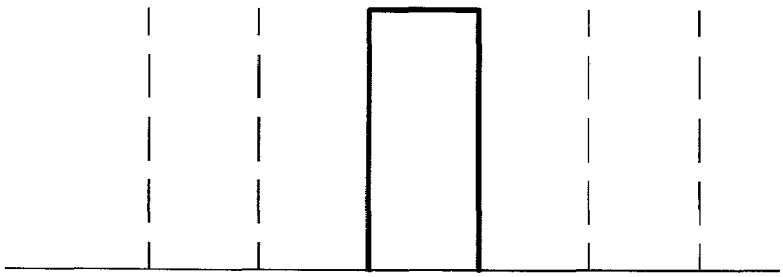
Figure 14C:
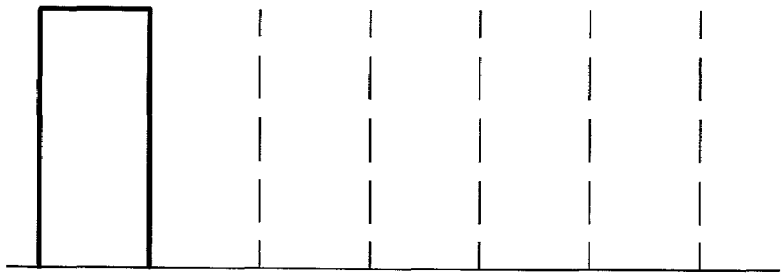
Figure 14D:
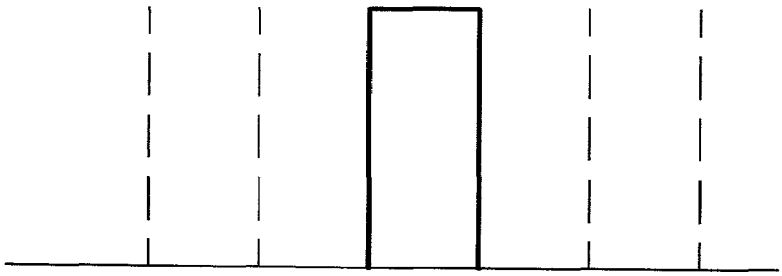

Time scattering is used to change the relation between output buffers 1110 and data lines 522 for each frame. FIGS. 13A to 13E illustrate a series of frames displayed by using time scattering, wherein column inversion is employed to perform polarity inversion and output buffer 1110(*j*) has an output offset voltage. Besides, scattering multiplexer 1140(*j*) successively selects digital data signals D' in the sequence D'(j), D'(j+2), D'(j+4), D'(j+2), D'(j), D'(j+2), and so on. FIG. 13A illustrates the first frame, where one vertical line with light gray color is formed associated with data line 522(j−1). FIG. 13B illustrates the second frame, where one vertical line with light gray color is formed associated with data line 522(j−2). FIG. 13C illustrates the third frame, where one vertical line with light gray color is formed associated with data line 522(j−5). FIG. 13D illustrates the fourth frame, where one vertical line with light gray color is formed associated with data line 522(j−2). FIG. 13E is equivalent to FIG. 13A. In brief, output buffer 1110(*j*) is associated with a different data line for each of the successive frames. Thus, the light gray lines due to output offset voltages are scattered so that they are almost imperceptible.

Time-and-space scattering is used to change the relation between output buffers 1110 and data lines 522 for each frame with each horizontal line. That is, undesired points originally associated with the same data line for one frame can be scattered over different frames and different data lines. Thus, the undesired points caused by the output offset voltages of output buffers 1110 are scattered equally and much more difficult to be perceived.

Figure 15:
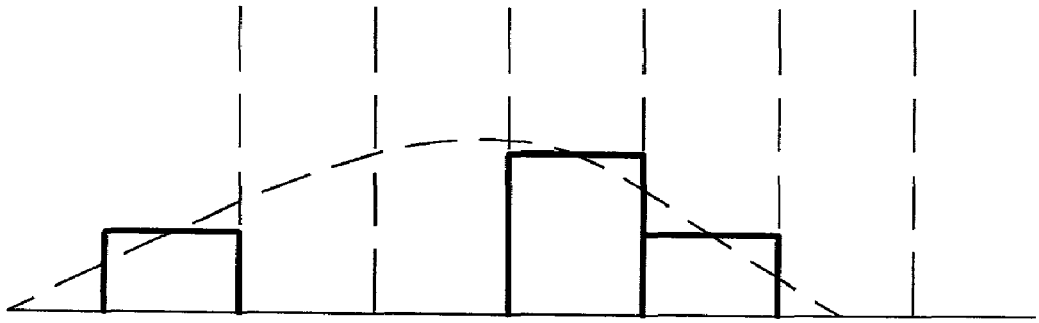
FIG. 15 is a graph of gray level intensity perceived by humans for the frames shown in FIGS. 13A–13D.

Scattering multiplexer 1140(*j*) can be configured to select one out of digital data signals D'(j), D'(j+2), and D'(j+4) according to a predetermined sequence, a random sequence, or a weighted curve. In the case of a weighted curve, digital data signals D' outputted to scattering multiplexer 1140(*j*) are associated with different weight values respectively. In this way, scattering multiplexer 1140(*j*) selects one out of digital data signals D'(j), D'(j+2), and D'(j+4) according to their associated weight values so as to change the relation between output buffers 1110 and data lines 522. If scattering multiplexer 1140(*j*) changes the relation between output buffers 1110 and data lines 522 according to a weighted curve, the display to be perceived is equivalent to the display resulting from convolving the weighted curve with the light gray intensities. For example in FIGS. 13A to 13E, digital data signals D'(j), D'(j+2), and D'(j+4) are associated with weight values 0.25, 0.5, and 0.25 respectively. FIGS. 14A to 14D show graphs of gray level intensity for the frames shown in FIGS. 13A–13D respectively. In addition, FIG. 15 is a graph of gray level intensity as perceived by humans for the frames shown in FIGS. 13A–13D successively. Equivalently, this graph shows the result of convolving the weighted curve with gray level intensity of a light gray line. In this way, the undesired points are scattered so that their gray level intensities perceived by humans are reduced. Besides, as can be seen from FIG. 15, the gray level intensities are distributed in the way such that the lines on the both sides have lower intensity than the line in the middle. As a whole, the display looks smoother, while the undesired points are difficult to perceive. Thus, the display quality is improved.

As disclosed above, the data signal scattering converter according to the invention scatters undesired points with abnormally deep or light colors due to output offset voltages from output buffers in the D/A converter, by changing the relation between the output buffers in the D/A converter and data lines so that the undesired points are not easy to perceive. Therefore, the degradation of uniformity of display brightness is reduced effectively and the display quality is improved.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for data signal scattering conversion in a data driver of a display panel, the apparatus comprising:

a first scattering multiplexer, directly connected to at least a first digital data signal, for selectively outputting one of the at least the first digital data signal as a first scattering data signal;

a second scattering multiplexer, directly connected to at least a second digital data signal and the first digital data signal, for selectively outputting one of the at least the first and second digital data signals as a second scattering data signal;

a first digital-to-analog converter, coupled to the first scattering multiplexer, and for performing digital-to-analog conversion on the first scattering data signal to generate a first analog data signal; and a second digital-to-analog converter, coupled to the second scattering multiplexer, for performing digital-to-analog conversion on the second scattering data signal to generate a second analog data signal;

wherein the first digital data signal is selectively outputted from one of at least the first and second scattering multiplexers so that the first digital data signal corresponds to the first and second analog data signals selectively.

2. The apparatus according to claim 1, wherein the first and second digital-to-analog converters are capable of performing polarity inversion.

3. The apparatus according to claim 1, further comprising a scattering demultiplexer, coupled between the display panel and the first digital-to-analog converters, for outputting the first analog data signal to one of at least two corresponding data lines of the display panel.

4. The apparatus according to claim 3, wherein the scattering demultiplexer has at least two output terminals, for outputting the first analog data signal through one of the output terminals.

5. The apparatus according to claim 1, wherein when the first digital data signal is outputted from one of the first and second scattering multiplexers alternately, the first digital data signal corresponds to the first and second analog data signals alternately.

6. The apparatus according to claim 1, further comprising a third scattering multiplexer, directly connected to the first digital data signal and selectively outputting the first digital data signal.

7. The apparatus according to claim 1, wherein the first scattering data signal is generated according to one of the at least the first and second digital data signals with associated weight values.

8. An apparatus according to claim 1, further comprising:

a first demultiplexer, coupled to the first digital-to-analog converter, the first demultiplexer including at least two output terminals, the first demultiplexer being for outputting the first analog data signal at one of the at least two output terminals of the first demultiplexer, selectively; and a second demultiplexer, coupled to the second digital-to-analog converter, the second demultiplexer including at least two output terminals, the second demultiplexer being for outputting the second analog data signal at one of the at least two output terminals of the second demultiplexer, selectively.

9. An apparatus according to claim 8, wherein:

the at least two of the output terminals of the first demultiplexer include a first output terminal of the, first demultiplexer, coupled to a first data line of the display panel; and the at least two of the output terminals of the second demultiplexer include a first output terminal of the second demultiplexer, coupled to a second data line of the display panel.

10. An apparatus according to claim 9, wherein the at least two of the output terminals of the second demultiplexer further include a second output terminal of the second demultiplexer, coupled to a specific data line of the display panel so that the second demultiplexer outputs the second analog data signal to the specific data line and the second data line selectively.

11. An apparatus according to claim 10, wherein when the second scattering multiplexer outputs the first digital data signal, and the second demultiplexer outputs the second analog data signal at the second output terminal of the first demultiplexer so that the second demultiplexer outputs the first digital data signal to the specific data line.

12. An apparatus according to claim 10, wherein the specific data line is the first data line.

13. A display apparatus with signal scattering conversion, comprising:

a display panel comprising a plurality of pixel units disposed in an array having n rows and m columns, m and n being positive integers greater than one; and a data driver, coupled to the display panel, for outputting m analog data signals according to digital image data for image forming, the data driver including a front-end processing device for receiving the digital image data and outputting m digital data signals, and a data signal scattering converter, coupled to the front-end processing device, for receiving the m digital data signals and outputting m analog data signals to the columns, wherein the data signal scattering converter includes:

a first scattering multiplexer, directly connected to at least an i-th digital data signal, for selectively outputting one of the at least the i-th digital data signals as a first scattering data signal, a second scattering multiplexer, directly connected to at least a j-th digital data signal and the i-th digital data signal, for selectively outputting one of the at least the i-th and j-th digital data signal as a second scattering data signal, a first digital-to-analog converter, coupled to the first scattering multiplexer, for performing digital-to-analog conversion on the first scattering data signal to generate a first analog data signal, and a second digital-to-analog converter, coupled to the second scattering multiplexer, for performing digital-to-analog conversion on the second scattering data signal to generate a second analog data signal;

wherein the i-th digital data signal is selectively outputted from one of at least the first and second scattering multiplexers so that the i-th digital data signal corresponds to the first and second analog data signals selectively.

14. The display apparatus according to claim 13, wherein the first and second digital-to-analog converters are capable of performing polarity inversion.

15. The display apparatus according to claim 13, wherein the data signal scattering converter further comprises a scattering demultiplexer, coupled between the display panel and the first digital-to-analog converters, for outputting the first analog data signal to be applied to one of at least two corresponding columns of the display panel.

16. The display apparatus according to claim 15, wherein the scattering demultiplexer has at least two output terminals, for outputting the first analog data signal through one of the output terminals.

17. The display apparatus according to claim 13, wherein when the i-th digital data signal is outputted from the first and second scattering multiplexers alternately, the i-th digital data signal corresponds to the first and second analog data signals alternately.

18. The display apparatus according to claim 13, wherein the data signal scattering converter further includes a third scattering multiplexer, directly connected to the i-th digital data signal and selectively outputting the i-th digital data signal.

19. A converter of a data driver for a display apparatus, comprising:

a first select device receiving a first input data signal;

a second select device outputting a first output signal;

a first digital-to-analog converter coupled between the first and the second select devices;

a second digital-to-analog converter coupled between the first and the second select devices; and a third select device receiving a first digital data signal and a second digital data signal, wherein the third select device selectively outputs the first or the second digital data signal as the first input data signal, wherein the first input data signal is selectively digital-to-analog converted by the first or the second digital-to-analog converter, and the first output signal is generated by the first or the second digital-to-analog converter.

20. The converter according to claim 19, further comprising:

a first buffer coupled between the first digital-to-analog converter and the second select device; and a second buffer coupled between the second digital-to-analog converter and the second select device, wherein the first output signal is selectively output from the first or the second buffer.

21. The converter according to claim 19, further comprising a fourth select device having a first output terminal and a second output terminal, wherein the fourth select device receives the first output signal and selectively outputs the first output signal through the first or the second output terminal.

22. The converter according to claim 19, further comprising a fourth select device coupled to the second digital-to-analog converter for receiving a second input data signal, wherein the second input data signal is selectively digital-to-analog converted by the second digital-to-analog converter.

23. The converter according to claim 22, wherein the second input data signal is digital-to-analog converted by the second digital-to-analog converter while the first input data signal is digital-to-analog converted by the first digital-to-analog converter.

24. The converter according to claim 19, further comprising a fourth select device coupled to the second digital-to-analog converter for outputting a second output signal, wherein the second output signal is selectively generated by the second digital-to-analog converter.

25. The converter according to claim 24, wherein the second output signal is generated by the second digital-to-analog converter while the first output signal is generated by the first digital-to-analog converter.

26. The converter according to claim 19, wherein polarity of the first output signal generated by the first digital-to-analog converter is different from that generated by the second digital-to-analog converter.

27. A converter of a data driver for a display panel including a plurality of data lines, comprising:

a first multiplexer, for receiving at least a first digital data signal and a second digital data signal, and selectively generating a first output data signal according to one of the at least the first and second digital data signals;

a first digital-to-analog converter for generating a first analog data signal according to the first output data signal; and a first demultiplexer, including a first output terminal and a second output terminal, for generating a first analog output signal according to the first analog data signal and outputting the first analog output signal from one of at least the first and second output terminals of the first demultiplexer, wherein the first and second output terminals of the first demultiplexer are used for coupling to a first data line and a specific data line of the display panel, respectively, so that the first analog output signal is applied to one of at least the first data line and the specific data line selectively, and wherein the first multiplexer, the first digital-to-analog converter, and the first demultiplexer correspond to the first data line.

28. The converter according to claim 27, further comprising:

a second multiplexer, for receiving at least the second digital data signal, and selectively generating a second output data signal according to one of the at least the second digital data signal;

a second digital-to-analog converter for generating a second analog data signal according to the second output data signal; and a second demultiplexer, including a first output terminal and a second output terminal, for generating a second analog output signal according to the second analog data signal and outputting the second analog output signal from one of at least the first and second output terminals of the second demultiplexer, wherein the first output terminal of the second demujltiplexer is used for coupling to a second data line of the display panel, and wherein the second multiplexer, the second digital-to-analog converter, and the second demultiplexer correspond to the second data line.

29. The converter according to claim 28, wherein the specific data line is the second data line.

* * * * *